US008308386B2

(12) United States Patent
Ki

(10) Patent No.: US 8,308,386 B2
(45) Date of Patent: Nov. 13, 2012

(54) PENCIL-SHAPED COSMETIC CONTAINER

(75) Inventor: Joong-Hyun Ki, Incheon (KR)

(73) Assignee: Yonwoo Co., Ltd. (KR)

( * ) Notice: Subject to any disclaimer, the term of this patent is extended or adjusted under 35 U.S.C. 154(b) by 0 days.

(21) Appl. No.: 13/060,472

(22) PCT Filed: Aug. 24, 2009

(86) PCT No.: PCT/KR2009/004711

§ 371 (c)(1),
(2), (4) Date: Feb. 24, 2011

(87) PCT Pub. No.: WO2010/024568

PCT Pub. Date: Mar. 4, 2010

(65) Prior Publication Data

US 2011/0158737 A1 Jun. 30, 2011

(30) Foreign Application Priority Data

Aug. 26, 2008 (KR) ..... 20-2008-0011398 U

(51) Int. Cl.
*B43K 5/18* (2006.01)
*A46B 11/02* (2006.01)

(52) U.S. Cl. ..... 401/188 R; 401/176; 401/187; 401/279

(58) Field of Classification Search ..... 401/176, 401/179, 187, 188 R, 189, 278, 279, 188 A; 222/375, 372, 383.1, 384, 378
See application file for complete search history.

(56) References Cited

U.S. PATENT DOCUMENTS

| | | | | |
|---|---|---|---|---|
| 2,987,743 | A * | 6/1961 | Capps | 401/135 |
| 4,624,413 | A * | 11/1986 | Corsette | 222/383.1 |
| 4,685,819 | A * | 8/1987 | Endo | 401/176 |
| 4,692,047 | A * | 9/1987 | Endo | 401/141 |
| 4,836,704 | A * | 6/1989 | Roeder | 401/146 |
| 4,963,046 | A * | 10/1990 | Eguchi | 401/160 |
| 4,991,749 | A * | 2/1991 | Kay et al. | 222/384 |
| 5,352,054 | A * | 10/1994 | Lhuisset | 401/269 |
| 6,056,470 | A * | 5/2000 | Nehashi et al. | 401/279 |
| 6,200,055 | B1 * | 3/2001 | Fusaro, Jr. | 401/178 |
| 6,948,875 | B1 * | 9/2005 | Jang | 401/146 |

(Continued)

FOREIGN PATENT DOCUMENTS

JP 2002-262932 9/2002

(Continued)

OTHER PUBLICATIONS

International Search Report-PCT/KR2009/004711 dated Jan. 14, 2010.

*Primary Examiner* — David Walczak
*Assistant Examiner* — Bradley Oliver
(74) *Attorney, Agent, or Firm* — Cantor Colburn LLP

(57) ABSTRACT

Disclosed is a pencil type cosmetic container, in particular to a pencil type cosmetic container which is directed to discharging cosmetic stuff to the outside by pressing upwards a button installed at a side surface of a cosmetic container, resulting in an easier use along with a simple construction for thereby decreasing a manufacture cost. In addition, it is easier to use since cosmetic stuff can be discharged by pressing upwards a button installed at a lateral side surface of a cosmetic container using one hand.

4 Claims, 5 Drawing Sheets

U.S. PATENT DOCUMENTS

| | | | | |
|---|---|---|---|---|
| 6,966,720 | B2 * | 11/2005 | Moss | 401/188 R |
| 7,497,635 | B1 * | 3/2009 | Bae | 401/188 R |
| 7,665,923 | B2 * | 2/2010 | Py et al. | 401/188 R |
| 2003/0185620 | A1 * | 10/2003 | Park | 401/270 |
| 2005/0139618 | A1 * | 6/2005 | Shanklin et al. | 222/383.1 |
| 2005/0169695 | A1 * | 8/2005 | Noguchi | 401/277 |
| 2011/0250007 | A1 * | 10/2011 | Kang | 401/179 |

FOREIGN PATENT DOCUMENTS

| | | |
|---|---|---|
| KR | 20-0408260 | 2/2006 |
| KR | 20-0439672 | 4/2008 |
| WO | 2007/064095 | 6/2007 |

* cited by examiner

PENCIL-SHAPED COSMETIC CONTAINER

TECHNICAL FIELD

The present invention relates to a pencil type cosmetic container, and in particular to a pencil type cosmetic container which is directed to discharging cosmetic stuff to the outside by pressing upwards a button installed at a side surface of a cosmetic container, which results in an easier use along with a simple construction for thereby decreasing a manufacture cost.

In addition, it is easier to use since cosmetic stuff can be discharged by pressing upwards a button installed at a side surface of a cosmetic container using one hand.

BACKGROUND ART

A cosmetic container stores eye cream, concealer, lip gloss, eye liner, etc. In particular, a user who needs smooth and fine makeup tends to use a pencil type cosmetic container.

However, a conventional pencil type cosmetic container is configured so that a user does a makeup directly putting part of cosmetics in a cosmetic container on a pencil, which causes a lot of inconvenience when in use, and a cosmetic container and a pencil are separately stored after use, so they might be lost.

In addition, a conventional cosmetic container, in which a cosmetics and a pencil are integral, is equipped with a pump at an inner side or is generally used by rotating a front tip of a pencil, both of which cost a lot in the course of manufacture.

DISCLOSURE OF INVENTION

Accordingly, it is an object of the present invention to provide a pencil type cosmetic container which is directed to discharging cosmetic stuff to the outside by pressing upwards a button installed at a side surface of a cosmetic container, which results in an easier use along with a simple construction for thereby decreasing a manufacture cost, while overcoming the problems encountered in a conventional art.

In the pencil type cosmetic container, it is easier to use since cosmetic stuff can be discharged by pressing upwards a button installed at a side surface of a cosmetic container using one hand.

To achieve the above objects, there is provided a pencil type cosmetic container which comprises a storing container for storing cosmetic stuff in the interior of the same; a housing which is inserted from an upper side to a lower side of the storing container, with a stopper, which corresponds to the size of an outer diameter of the storing container, being protruded from an outer side of the housing, with a through inlet hole being formed at a lower side of the housing, with a first check valve being installed at an upper side of the inlet hole for opening and closing the inlet hole with the aid of a pressure applied to the cosmetic stuff; a middle container which is engaged to an upper side of the storing container, with a curved part being formed at a lower side of the middle container for limiting the movement of the stopper, with a through button engaging hole being formed at one side of the middle container; a seal cap of which the center is hollow, an upper side is inserted into the interior of the middle container, and a lower side is inserted into the interior of the housing and is movable in a vertical direction, with a second check valve being installed at an upper side of the seal cap for opening and closing the center; a button which passes through the button engaging hole and is engaged to one side of the seal cap; a rod part of which the center is hollow and which is installed at an upper side of the middle container, with a discharge part being protruded upwards; a recovery spring which is installed between the seal cap and the rod part; and an applicator which is inserted into an upper side of the discharge part and absorbs the cosmetic stuff discharged from the rod part.

There is further provided a piston which is installed at a lower side of the storing container and is contracted as much as the volume of the cosmetic stuff which was used, and moves in an upward direction of the storing container.

The seal cap further comprises a pressing rod of which one side is extended downwards for thereby pressing an upper side of the first check valve.

The seal cap further comprises a button engaging groove engaged with the button.

The center of the seal cap is formed in a passing-through hole shape with above a diameter size of the inlet hole.

ADVANTAGEOUS EFFECTS

In the present invention, the pencil type cosmetic container is directed to discharging cosmetic stuff to the outside by pressing upwards a button installed at a side surface of a cosmetic container, which results in an easier use along with a simple construction for thereby decreasing a manufacture cost.

In addition, it is easier to use since cosmetic stuff can be discharged by pressing upwards a button installed at a side surface of a cosmetic container using one hand.

BRIEF DESCRIPTION OF THE DRAWINGS

The present invention will become better understood with reference to the accompanying drawings which are given only by way of illustration and thus are not limitative of the present invention, wherein.

BEST MODES FOR CARRYING OUT THE INVENTION

Figure 1:
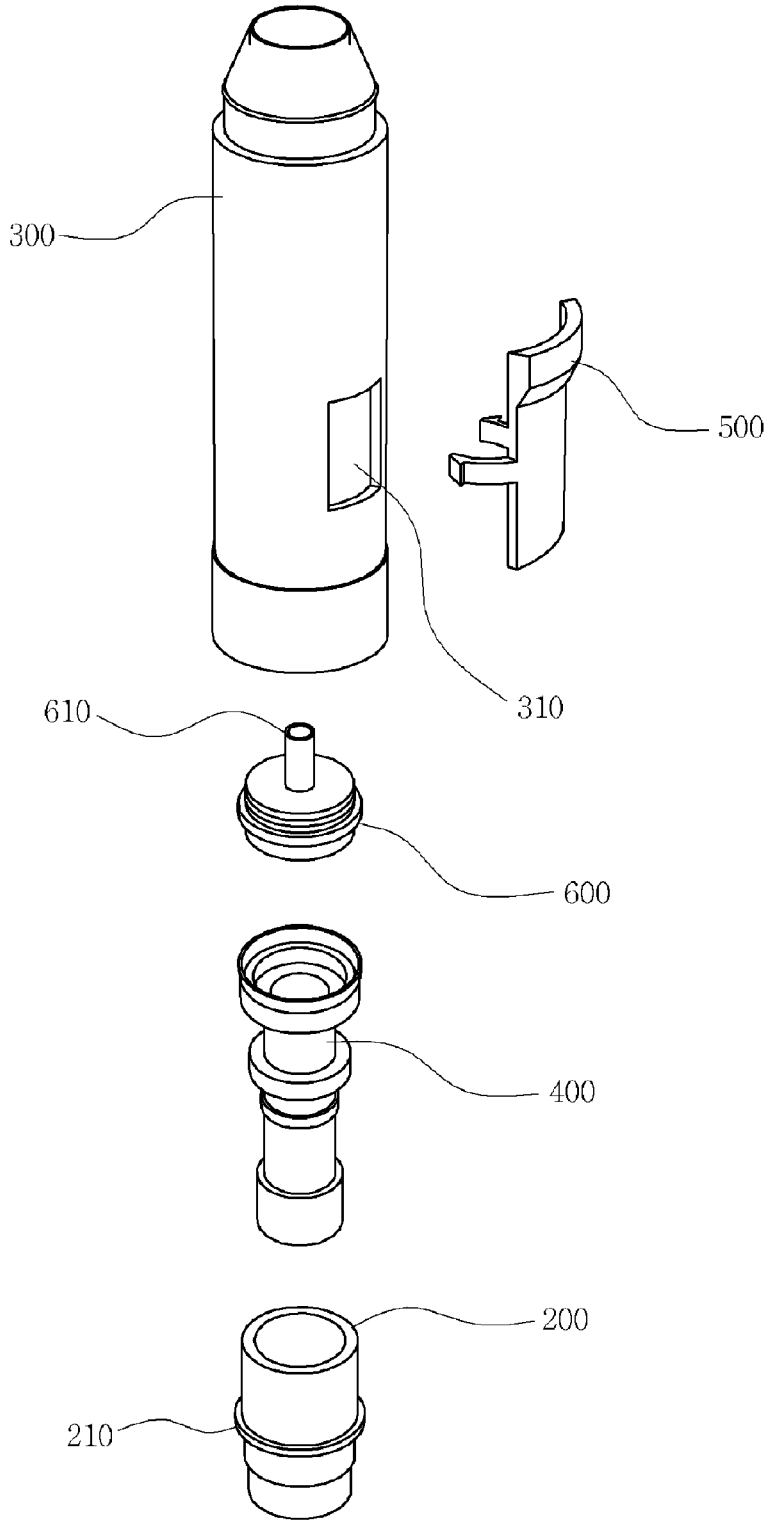
FIG. 1 is a disassembled perspective view illustrating a pencil type cosmetic container according to a preferred embodiment of the present invention.

The preferred embodiments of the present invention will be described with reference to the accompanying drawings. The same elements shown in each drawing will be given the same reference numerals.

Figure 2:
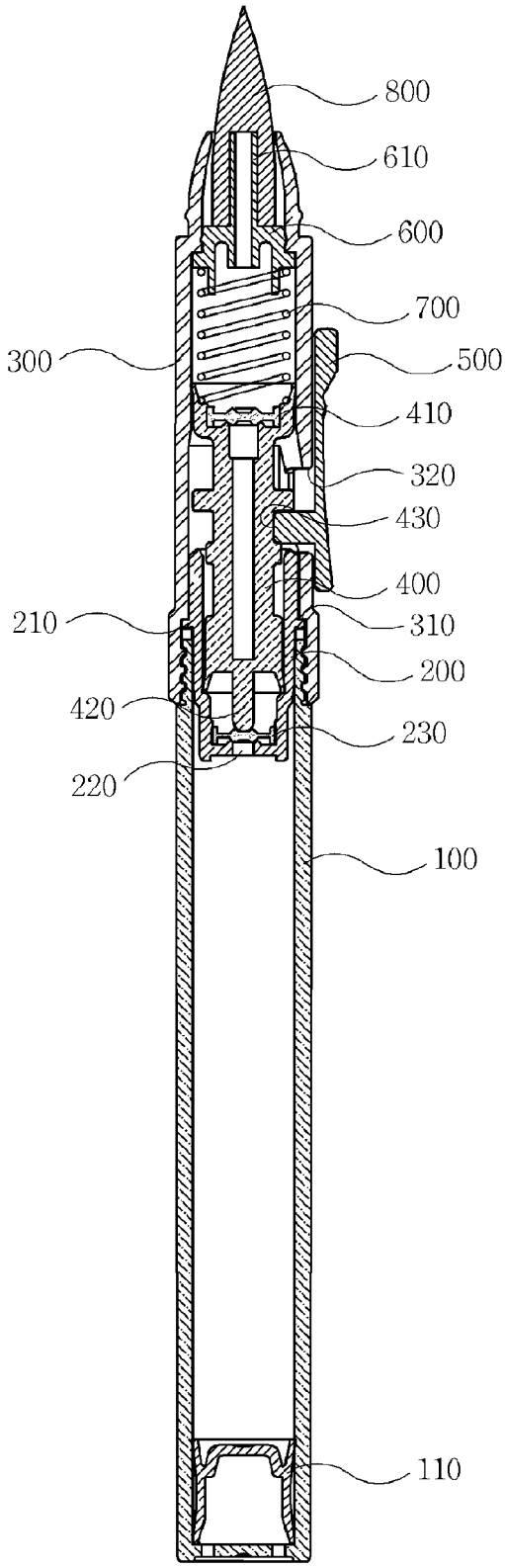
FIG. 2 is a cross sectional view illustrating a pencil type cosmetic container according to a preferred embodiment of the present invention.
Figure 3:
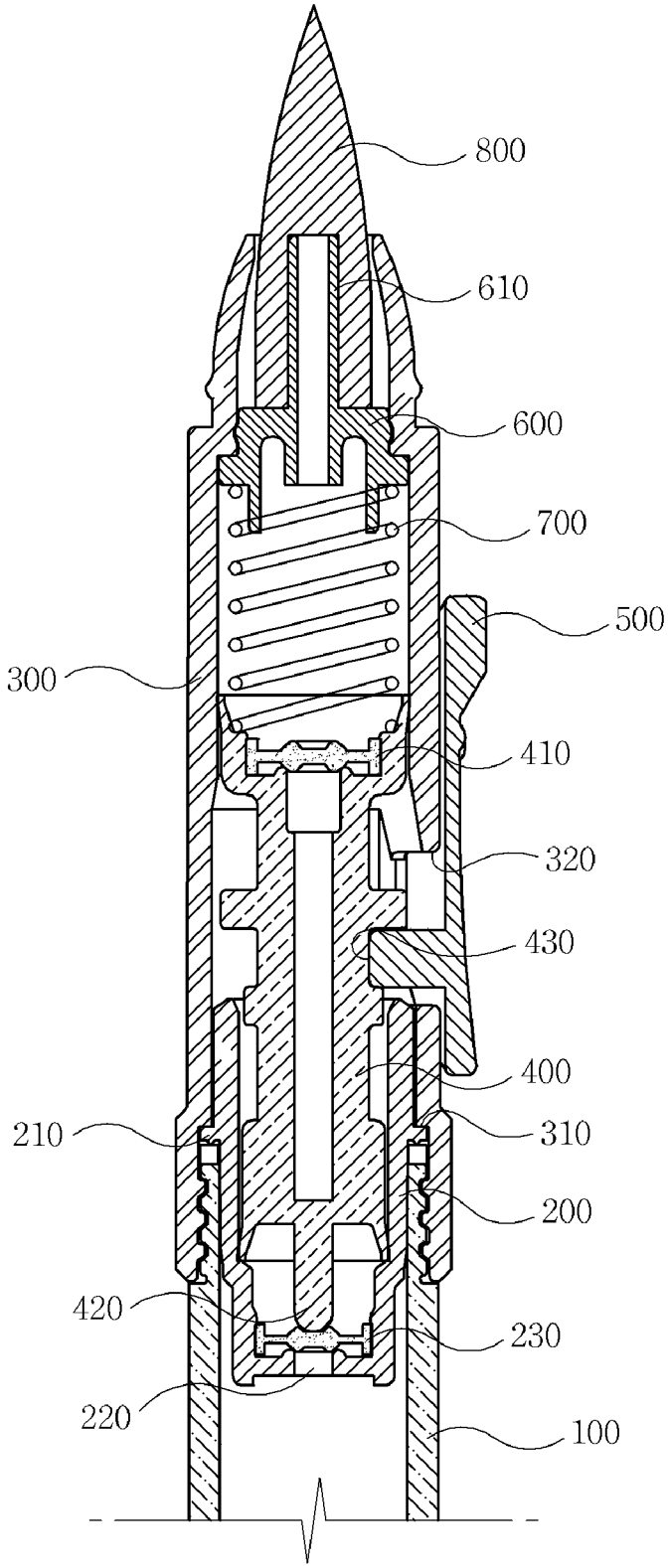
FIG. 3 is an enlarged view illustrating a pencil type cosmetic container according to a preferred embodiment of the present invention.

FIG. 1 is a disassembled perspective view illustrating a pencil type cosmetic container according to a preferred embodiment of the present invention, and FIG. 2 is a cross sectional view illustrating a pencil type cosmetic container according to a preferred embodiment of the present invention, and FIG. 3 is an enlarged view illustrating a pencil type cosmetic container according to a preferred embodiment of the present invention.

As shown in FIGS. 1 to 3, the pencil type cosmetic container according to the present invention comprises a storing container 100, a housing 200, a middle container 300, a seal cap 400, a button 500, a rod part 600, a recovery spring 700 and an applicator 800. A piston 110, a pressing rod 420 and a button engaging groove 430 might be further provided.

The storing container 100 is designed to store various cosmetic stuff such as eye cream, canceller concealer, lip gloss, etc. The storing container 100 is made from a synthetic resin material of plastic, with a piston 110 being engaged to a lower part of the storing container 100.

The piston 110 is pressed by a certain distance depending on the volume of the cosmetics varying as a user uses cosmetic stuff and moves toward the upper side of the storing container 100. So, a user can use cosmetics until all of the remaining cosmetic stuff runs out without a user swaying the storing container upwards and downwards or storing in an opposed side of a discharge part even when a bit amount of cosmetics remains. It is preferred that the piston 110 is made of a smooth material so that an inner space of the storing container 100 can keep a vacuum state.

The housing 200 is installed at an upper side of the storing container 100, so cosmetic stuff is inputted from the storing container 100 into the interior of the housing. The inner diameter of the housing 200 is the same as the outer diameter of the storing container 100, so the housing is inserted from the upper side to the lower side of the storing container 100. At this time, a stopper 210 is protruded from an outer side of the storing container 100 for thereby limiting the housing 200 from entering into the interior of the storing container 100.

It is preferred that the stopper 210 is protruded in the same size as the outer diameter of the storing container 100. The upper side of the stopper 210 is blocked by means of the middle container 300, which will be described later, and is fixed.

An inlet hole 220 is formed at a lower side of the housing 200, while passing through the same. Cosmetic stuff is inputted into the interior of the housing 200 with the aid of external pressure. It is preferred that the inlet hole 220 is formed at the center of the housing 200 so that cosmetic stuff can naturally input into the interior.

Figure 4:
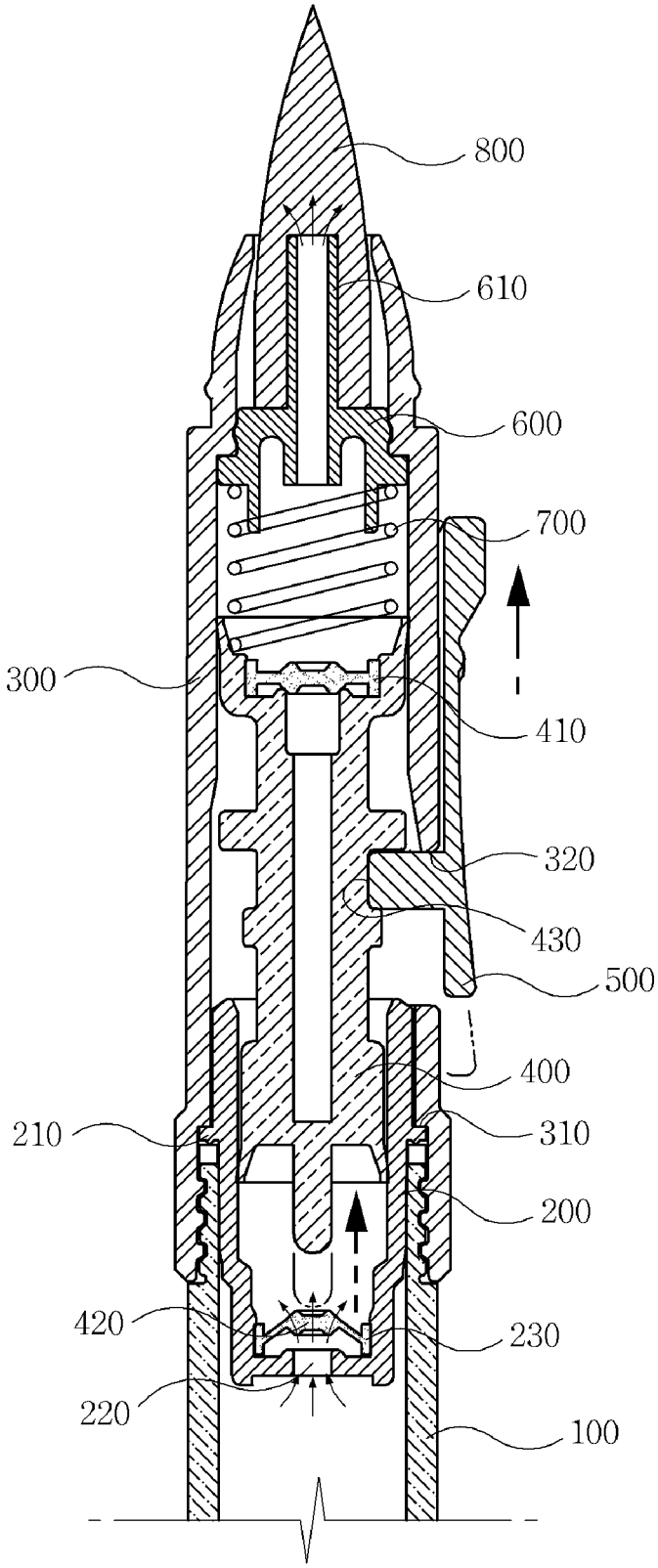
FIG. 4 is a view of an operation state when a user presses upwards a button of a pencil type cosmetic container according to a preferred embodiment of the present invention.
Figure 5:
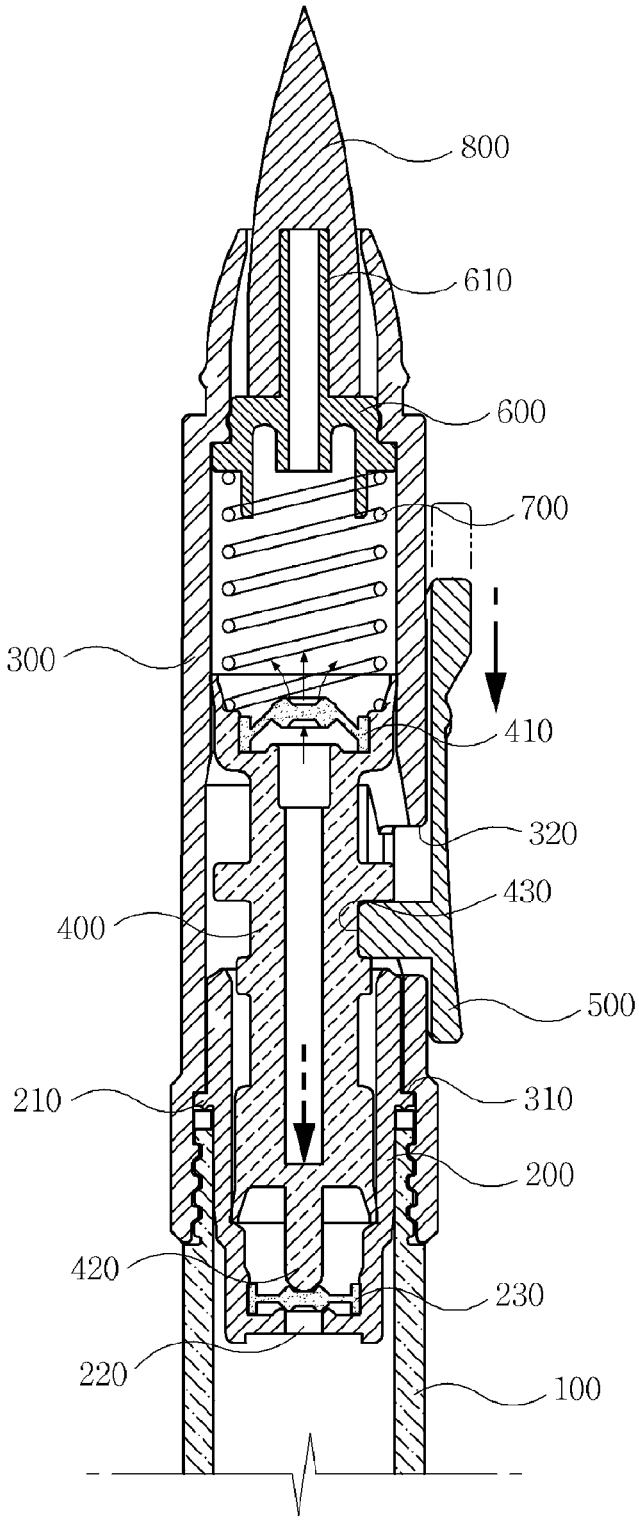
FIG. 5 is a view of an operation state when a button returns to its initial position with the aid of a button recovery spring of a pencil type cosmetic container according to a preferred embodiment of the present invention.

A first check valve 230 is installed at a lower side of the housing 200 for thereby closing the inlet hole 220. As shown in FIG. 4, when pressure is applied to the upper side of the first check valve 230, the central portion opens upwards, and cosmetic stuff is inputted via the inlet hole 220. As shown in FIG. 5, when pressure is applied to the lower side of the first check valve 230, it comes into close contact with the inlet hole 220, so the cosmetic stuff is prevented from inputting into the interior of the housing 200. It is preferred that the first check valve 230 is made of a certain material which helps transform the first check valve depending on the pressure applied to the cosmetic stuff.

The middle container 300 is installed at the upper side of the housing 200, with a curved part 310 being formed at a lower side of the middle container for thereby limiting the movement of the stopper 210. A button engaging hole 320 passes through the middle container 300 for engaging the button 50 to the seal cap 400 which will be described later.

The inner diameter of the curved part 310 is the same as the outer diameter of the housing 200 for thereby preventing from escaping from the upper side of the storing container 100 when pressure is applied to the cosmetics.

A button engaging hole 320 passes through one side of the middle container 300 for helping the button 500 engage with the seal cap 400. It is preferred that the button engaging hole 320 passes through in a vertical direction so that the button 500 can move upwards and downwards.

The seal cap 400 is engaged with the button 500 and moves in a vertical direction upwards and downwards when an external force from a user is applied, with the center of the seal cap 400 being hollow. The upper and lower sides of the seal cap 400 are inserted into the middle container 300 and the housing 200. When the seal cap 400 moves upwards, the cosmetic stuff positioned in the interior of the storing container 100 moves to the upper side of the seal cap 400 with the aid of atmospheric pressure difference to the outside. At this time, it is preferred that the center of the seal cap 400 is larger than the diameter of the inlet hole 220 for thereby making the flowing speed of the cosmetic stuff in the seal cap 400 slower, which results in reliably transmitting the cosmetic stuff to the discharge part 610 which will be described later.

A second check valve 410 is installed at the upper side of the seal cap 400 for thereby opening and closing the central portion of the seal cap 400 with the aid of pressure applied to the cosmetic stuff. When pressure is applied to the upper side, the center of the second check valve 410 is spaced apart upwards, so cosmetic stuff is inputted via the center of the seal cap 400. When pressure is applied to the lower side of the second check valve 410, it comes into close contact with the center of the seal cap 400, so the cosmetic stuff is prevented from inputting into the interior of the seal cap 400. It is preferred that the second check valve 410 is made of a certain smooth material, so the second check valve 410 can transform depending on the pressure applied to the cosmetic stuff. The second check valve 410 had the same operational structure as the first check valve 230.

A pressing rod 420 might be extended from a lower side of the seal cap 400 for pressing the upper side of the first check valve 230. Since the pressing rod 420 presses the upper side of the first check valve 230, it is possible to prevent the movement of the first check valve 230. Even when external pressure occurs, the pressing rod 420 prevents the movement of the first check valve 230. The pressing rod 420 is basically directed to preventing the cosmetic stuff from leaking by means of external pressure.

In addition, the seal cap 400 might be equipped with a button engaging groove 430 at its one side for an easier engagement with the button 500. It is preferred that the button engaging groove 430 is installed at a lower side of the button engaging hole 320 so that the button 500 can move upwards when the button 500 is engaged.

The button 500 is engaged at one side of the seal cap 400 for thereby moving the seal cap 400 upwards with the aid of a user's external force. The button 500 passes through the button engaging hole 320 from the outside of the storing container 100 and is engaged to the seal cap 400. It is preferred that the button 500 is installed at a lower side of the button engaging hole 320 and is movable upwards by means of an external force.

The rod part 600 is installed at an upper side of the middle container 300, with its central portion being hollow for thereby receiving cosmetic stuff from the lower side and discharging the same upwards. A discharge part 610 is upwardly protruded from the center of the rod part 600 for thereby discharging cosmetic stuff toward the discharge part 610, and the discharge part 610 is engaged with an applicator 800 which will be described later. The rod part 600 is designed to discharge cosmetic stuff and provides the cosmetic stuff to the user via the applicator 800.

The recovery spring 700 is installed between the seal cap 400 and the rod part 600 for thereby allowing the seal cap 400 to continue to ascend and descend. The lower side of the recovery spring 700 is mounted on the upper side of the seal cap 400, and the upper side of the same is installed at the lower side of the rod part 600. When a user presses the upper side of the button 500, the seal cap 400 vertically ascends at the same time. At this time, the seal cap 400 vertically descends downwards with the aid of the elastic recovery force of the recovery spring 700. Namely, the recovery spring 700 allows the seal cap 400 to continuously ascend and descend by using an elastic recovery force.

The lower side of the applicator 800 is engaged to the discharge part 610. Part of the same is exposed by a certain length, so cosmetic stuff can be put on a user's skin. The applicator 800 helps discharge the cosmetic stuff to the outside, which is discharged from the discharge part 610. The applicator 800 comprises a brush made of natural hair materials or a silicon tip made of a smooth material. It is preferred that it can feel smooth when touching a user's skin.

The operation procedures of a side-processed type cosmetic container according to a preferred embodiment of the present invention will be described with reference to FIGS. 4 and 5.

As shown in FIG. 4, a user holds the cosmetic container. The button 500 is pressed upwards using a thumb and moves upwards. At this time, as the button 500 ascends, the seal cap 400 engaged with the button 50 also ascends upwards.

When the seal cap 400 moves upwards, the space between the seal cap 400 and the rod part 600 decreases. At this time, since the second check valve 410 blocks the center of the seal cap 400, the cosmetic stuff stored between the seal cap 400 and the rod part 600 is discharged upwards via the discharge part 610. So, the user can use cosmetic stuff by simply pressing the button 500 upwards, which is one of the key features of the present invention.

When the seal cap 400 ascends, a pressure difference occurs between the inner and outer sides of the housing 200, so the cosmetic stuff stored in the interior of the storing container 100 ascends into the interior of the housing 200 via the first check valve 230. As the cosmetic stuff stored in the interior of the storing container 100 ascends upwards, the piston 110 moves upwards by a distance corresponding to the volume of the cosmetic stuff which moves upwards. At this time, the recovery spring 700 is positioned in the state pressed by means of the seal cap 400.

As shown in FIG. 5, when a user separates a thumb from the button 500, the seal cap 400 vertically descends downwards by means of an elastic recovery force of the recovery spring 700. As the seal cap 700 descends, the first check valve 230 is closed, and the second check valve 410 is opened. The cosmetic stuff stored in the interior of the housing 200 moves upwards along the center of the seal cap 400. The cosmetic stuff which was moved upwards along the center of the seal cap 400 is finally positioned between the seal cap 400 and the rod part 600. So, the cosmetic stuff remains like before the button 500 is pressed. Namely, the user can easily use cosmetic stuff in an easier way by simply pressing the button installed at an outer side.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A pencil type cosmetic container, comprising:

a storing container for storing cosmetic stuff in the interior of the same;

a housing which is inserted into an upper side of the storing container, the housing having a stopper protruded from an outer side of the housing, and a through inlet hole being formed at a lower side of the housing;

a first check valve being installed at an upper side of the through inlet hole for opening and closing the through inlet hole with the aid of a pressure applied to the cosmetic stuff;

a middle container which is engaged to an upper side of the storing container, the middle container having a curved part being formed at a lower side of the middle container for limiting the movement of the stopper, and a through button engaging hole being formed at one lateral side of the middle container;

a seal cap of which the center is hollow, an upper side of which is inserted into the interior of the middle container, and a lower side of which is inserted into the interior of the housing, the seal cap having a pressing rod integrally formed with the seal cap and extending downwards to press an upper side of the first check valve such that the first check valve closes the through inlet hole;

a second check valve being installed at an upper side of the seal cap for opening and closing the hollow center;

a button which is engaged with the seal cap through the button engaging hole such that, when the button is pressed upward by a user, the seal cap moves upward along with the button;

a rod part of which the center is hollow and which is installed at an upper side of the middle container, with a discharge part being protruded upwards;

a recovery spring which is installed between the seal cap and the rod part such that the button pressed upward is released by the user, the seal cap is automatically restored and the pressing rod presses the first check valve to close the inlet hole; and an applicator which is inserted into an upper side of the discharge part and is adapted to absorb the cosmetic stuff discharged from the rod part.

2. A pencil type cosmetic container according to claim 1, further comprising:

a piston which is installed at a lower side of the storing container and is contracted as much as the volume of the cosmetic stuff which was used, and moves in an upward direction of the storing container.

3. A pencil type cosmetic container according to claim 1, wherein said seal cap further comprises a button engaging groove engaged with the button.

4. A pencil type cosmetic container according to claim 1, wherein the center of the seal cap is formed in a passing-through hole shape with above a diameter size of the inlet hole.

* * * * *